US012337210B2

(12) United States Patent
Delgatty

(10) Patent No.: US 12,337,210 B2
(45) Date of Patent: Jun. 24, 2025

(54) CONVERTIBLE EXERCISE MACHINE

(71) Applicant: THE MINTER METHOD, LLC, Los Angeles, CA (US)

(72) Inventor: Grant Verdun Delgatty, La Canada Flintridge, CA (US)

(73) Assignee: The Minter Method, LLC, Los Angeles, CA (US)

( * ) Notice: Subject to any disclaimer, the term of this patent is extended or adjusted under 35 U.S.C. 154(b) by 194 days.

(21) Appl. No.: 18/348,999

(22) Filed: Jul. 7, 2023

(65) Prior Publication Data

US 2024/0009512 A1 Jan. 11, 2024

Related U.S. Application Data

(60) Provisional application No. 63/359,187, filed on Jul. 7, 2022.

(51) Int. Cl.

| | |
|---|---|
| ***A63B 22/20*** | (2006.01) |
| ***A63B 21/00*** | (2006.01) |
| ***A63B 21/002*** | (2006.01) |
| ***A63B 21/02*** | (2006.01) |
| ***A63B 21/04*** | (2006.01) |

(52) U.S. Cl.

CPC ..... *A63B 22/203* (2013.01); *A63B 21/00061* (2013.01); *A63B 21/002* (2013.01); *A63B 21/023* (2013.01); *A63B 21/0428* (2013.01); *A63B 21/4035* (2015.10); *A63B 22/205* (2013.01); *A63B 2210/50* (2013.01); *A63B 2225/09* (2013.01)

(58) Field of Classification Search

CPC ..... A63B 21/4035; A63B 21/00061; A63B 21/0023; A63B 21/023; A63B 21/0428; A63B 22/203; A63B 22/205; A63B 2225/09

See application file for complete search history.

(56) References Cited

U.S. PATENT DOCUMENTS

| | | | | |
|---|---|---|---|---|
| 6,669,609 | B2 | 12/2003 | Gerschefske et al. | |
| 7,803,095 | B1 | 9/2010 | LaGree | |
| 10,155,129 | B2 * | 12/2018 | Lagree | A63B 21/023 |
| 10,238,910 | B2 * | 3/2019 | Lagree | A63B 23/0233 |
| 2003/0119635 | A1 | 6/2003 | Arbuckle et al. | |
| 2008/0248935 | A1 * | 10/2008 | Solow | A63B 21/154 482/142 |
| 2009/0098987 | A1 | 4/2009 | McBride et al. | |

(Continued)

FOREIGN PATENT DOCUMENTS

KR 20-0496807 Y1 4/2023

OTHER PUBLICATIONS

International Search Report and Written Opinion received for PCT Patent Application No. PCT/US23/27160, mailed on Oct. 4, 2023, 10 pages.

*Primary Examiner* — Zachary T Moore

(74) *Attorney, Agent, or Firm* — Smith, Gambrell & Russell LLP

(57) ABSTRACT

An exercise machine that is capable of being placed in both horizontal, transitional, and vertical orientations through a variety of components. The exercise machine can be stored in its vertical orientation to eliminate an unnecessary occupation of space while the machine is not in use. While stored, the exercise machine can serve additional functionalities.

11 Claims, 13 Drawing Sheets

(56) References Cited

U.S. PATENT DOCUMENTS

| | | | | |
|---|---|---|---|---|
| 2012/0295771 | A1* | 11/2012 | LaGree ..... | A63B 22/203 482/94 |
| 2018/0133533 | A1 | 5/2018 | Lagree et al. | |
| 2020/0222741 | A1 | 7/2020 | Aronson | |

* cited by examiner

CONVERTIBLE EXERCISE MACHINE

CROSS-REFERENCE TO RELATED APPLICATIONS

This application claims the benefit of and priority to U.S. Provisional Application Ser. No. 63/359,187, filed Jul. 7, 2022, the contents of which are hereby incorporated by reference as if recited in full herein for all purposes.

FIELD OF INVENTION

This invention generally relates to a convertible exercise machine for use in exercises such as Pilates.

BACKGROUND OF THE INVENTION

Some full body workout exercise equipment or machines occupy considerable space and can be bulky, heavy, and difficult to move. Certain exercise machines, commonly referred to as Pilates reformers, typically consist of a large frame between about 80 in. up to about 100 in. in length and about 24 in. up to about 36 in. in width. Such machines use a platform surface that moves back and forth under tension along the frame.

In addition to the moving platform, Pilates-type equipment or machines may have other features, such as handles for holding onto and leaning against when performing certain exercises, cables connected to the platform through a pulley system, and other such features known in the art.

The user of the machine is able to engage in numerous exercise methods by interacting with the different components as described above, with many of the exercises allowing the tensioned rolling platform to provide variable resistance when performing these exercises.

In order to provide support for exercises performed on Pilates-type equipment, the machine is typically required to be large and bulky. In some cases, the machine can be smaller and lower to the ground; however, this can be problematic for performing certain exercises that require a higher platform to sit or step onto. As such, there is a correlation between the utility of a machine and the required space.

The above relates to some limitations of current products on the market. Therefore, there exists a need for an improved exercise machine to address limitations of current products and provide additional functionalities and improvements.

SUMMARY OF THE INVENTION

It is to be understood that this summary is not an extensive overview of the disclosure. This summary is exemplary and not restrictive and it is intended to neither identify key or critical elements of the disclosure nor delineate the scope thereof. The sole purpose of this summary is to explain and exemplify certain concepts of the disclosure as an introduction to the following complete and extensive detailed description.

The present disclosure relates to an exercise machine. The exercise machine is configured to be folded into a vertical orientation to facilitate storage. The exercise machine is configured to maintain its length when transitioning from a horizontal to vertical orientation, and vice versa. The exercise machine comprises a frame configured to support a user, as well as a moving platform capable of sliding along the frame. The moving platform moves along a length of the frame as it slides. A variety of exercises can be performed when the machine is in either the horizontal or vertical orientation using the moving platform in combination with cable and pulley systems.

The exercise machine makes use of one or more locking mechanisms to lock the machine in various orientations (e.g. horizontal, transitional, vertical, and the like). Locking mechanisms may include latches, hooks, locking arms, and other such mechanisms known in the art. The one or more locking mechanisms engage one or more spacer rods coupled to the frame to lock the exercise machine in various chosen orientations.

The exercise machine further comprises a plurality of handlebars that are capable of being adjusted by rotating them 360 degrees about an axis. The handlebars can be locked at positions in increments of 90 degrees through engagement of a locking pin in various notches. The plurality of handlebars is also capable of being removed from the machine and stored in various locations within the machine. This functionality may allow for ease of storage of the exercise machine. As a non-limiting example, removing handlebars may allow for storage in locations where the length of the machine is longer than the height of the location.

The exercise machine further comprises one or more wheel assemblies. Such wheel assemblies may be positioned within a channel of the frame and assist the moving platform in sliding smoothly and linearly along the frame. The wheel assemblies may comprise a first wheel with a diameter oriented parallel to the length of the exercise machine and a second wheel with a diameter oriented perpendicular to the length of the exercise machine. Wheels may be selected from a variety of materials including, but not limited to, polymers. Such polymers may include polyurethane.

The exercise machine may further comprise a plurality of adjustable springs. Such springs may include a variety of springs of varied spring coefficients. Such springs are configured to engage one or more securing devices at one end and are coupled to the frame at an opposing end. The securing device coupled to one or more springs is configured to be received within one or more notches of a platform finger bracket coupled to an end of the moving platform. By selectively positioning chosen combinations of types (i.e. springs of varying spring coefficients) and quantities of springs within the one or more notches of the platform finger bracket, adjustable tension levels are provided to the exercise machine.

Securing devices may include knobs. Knobs may include a number of modular components. Such modular components may form two sets of modular components. A first set may be configured to engage a loop affixed to a spring through a number of slots. A second set may be configured to slidably engage the first set through grooves located on both sets. Once fully formed, securing devices are configured to receive an outer ring on a number of notches to provide structural support to the securing device.

BRIEF DESCRIPTION OF THE DRAWINGS

The accompanying drawings are included to provide a further understanding of the invention and are incorporated in and constitute part of this specification, as well as illustrate several embodiments of the invention that together with the description serve to explain the principles of the invention.

FIGS. 2A-2C show an exercise machine in horizontal (FIG. 2A), transitional (FIG. 2B), and vertical (FIG. 2C) orientations.

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the following description, numerous specific details are set forth. However, it is to be understood that embodiments of the invention may be practiced without these specific details. In other instances, well-known methods, structures, and techniques have been shown in detail in order not to obscure an understanding of this description.

Figure 1:
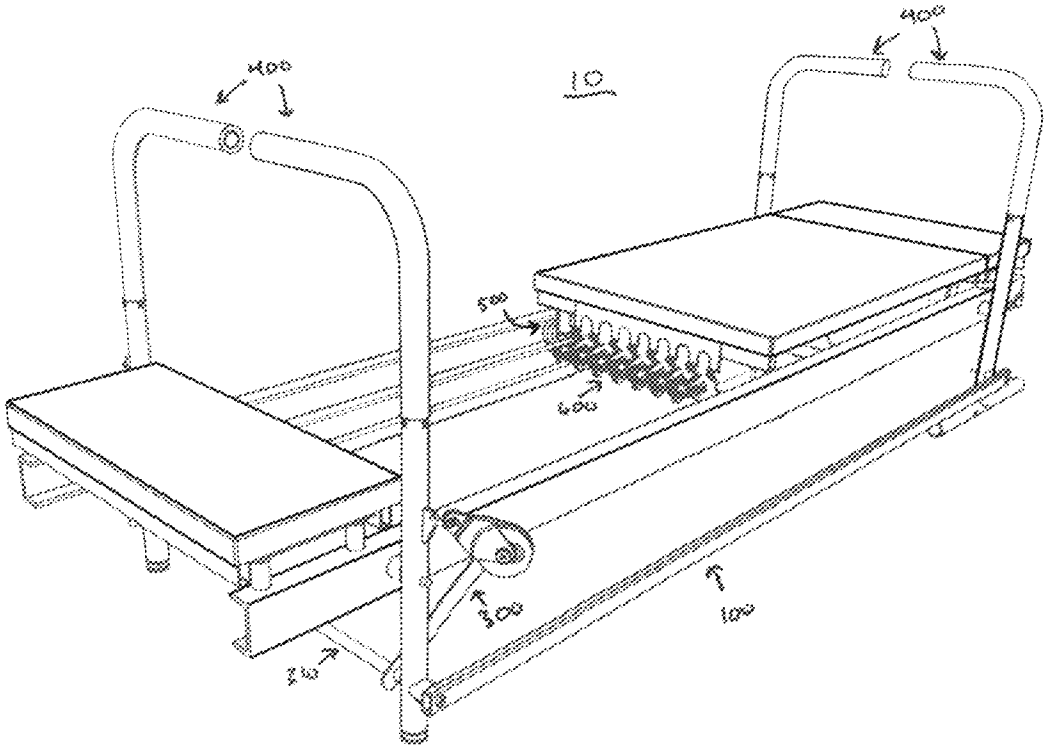
FIG. 1 shows a view of an exercise machine according to the present disclosure.
Figure 7C:
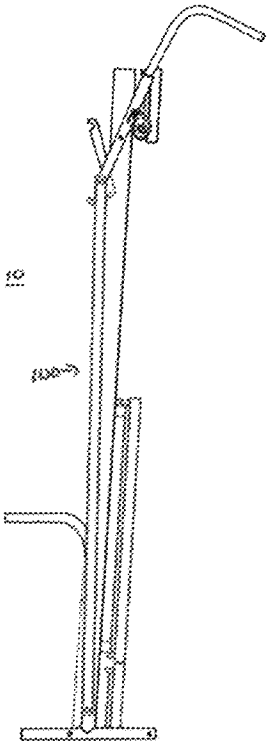
FIG. 7 shows a side view of a wheel assembly according to the present disclosure.
Figure 7A:
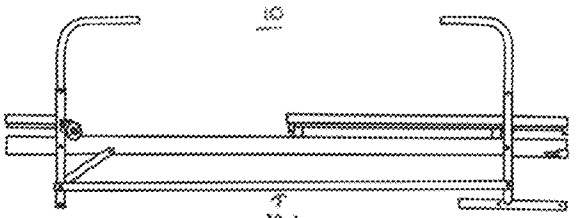
Figure 7B:
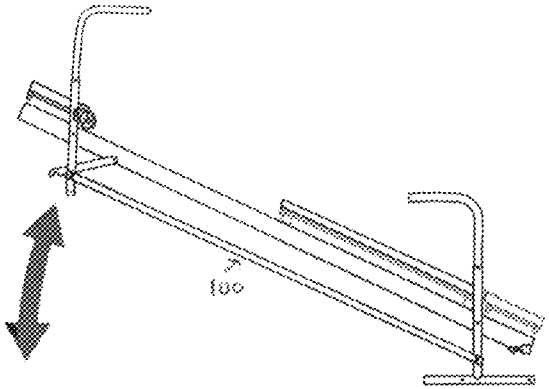

The present disclosure relates to an exercise machine 10, as shown in FIG. 1. The exercise machine may be used to perform exercises similar to those developed by Joseph Pilates and generally referred to as Pilates. In such capacity, a holistic full body workout can be achieved through use of the exercise machine, wherein the exercise machine comprises a frame to support a user. The exercise machine of the present disclosure comprises a variety of features and functionalities. These features and functionalities address limitations existing in the prior art. As a non-limiting example, the limitation of current exercise machines requiring a large amount of space due to their size and bulkiness is addressed. Additional limitations are also addressed.

The present disclosure relates to an exercise machine that is configured to be oriented in more than one orientations, as shown in FIGS. 2A-2C and FIGS. 11A-11B. This allows for the exercise machine to be quickly and easily stored, providing a minimal footprint and allowing sufficient room for other activities. An exercise machine may be placed in a horizontal orientation, as shown in FIG. 2A. The exercise machine includes a length that extends parallel to the floor from one end of the machine to an opposing end of the machine when said machine is in a horizontal orientation, as shown in FIG. 2A. This length may be equal to the length of the frame of an exercise machine. While in a horizontal orientation, a moving platform joined to a portion of the frame of the machine is capable of moving along the length of the frame. Such movement facilitates the performance of a variety of exercises. The exercise machine may be lifted, resulting in a transitional orientation as shown in FIG. 2B. The exercise machine may be placed in a vertical orientation, as shown in FIG. 2C. During a transition from a horizontal orientation (FIG. 2A) to a vertical orientation (FIG. 2C), and vice versa, the length, as described above, does not change. Such functionality leads to the ability of the height of a vertically oriented machine to be equal to the length of a horizontally oriented machine. While in a vertical orientation, the footprint of an exercise machine is reduced. Such a reduction allows an exercise machine to be easily stored. The maintenance of machine length during transition, as previously described, also allows a vertically oriented machine to still be used to perform a variety of exercises. With the height of a vertically oriented machine being equal to the length of a horizontally oriented machine, a number of exercises are still capable of being performed while the machine is vertical. These exercises include but are not limited to various pull down exercises known in the art. Such exercises are performed using the moving platform in combination with cable and pulley systems of an exercise machine. Connecting tubes 100 may be employed to facilitate the transition from horizontal to vertical, and vice versa, of an exercise machine, as shown in FIGS. 2A-2B. Connecting tubes are joined to the base of the frame of an exercise machine. Connecting tubes may provide structural support to the exercise machine.

Figure 3B:
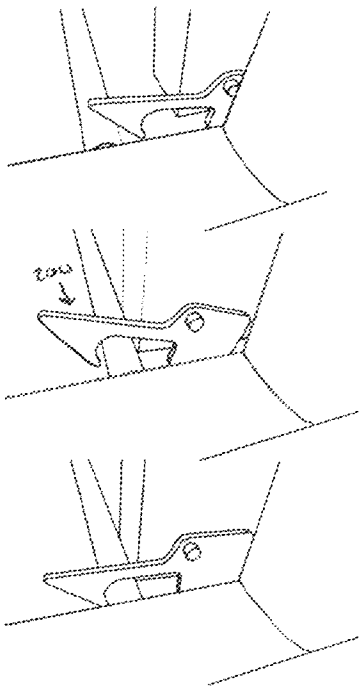
FIGS. 3A-3B show side (FIG. 3A) and top (FIG. 3B) views of a locking mechanism according to the present disclosure.
Figure 3A:
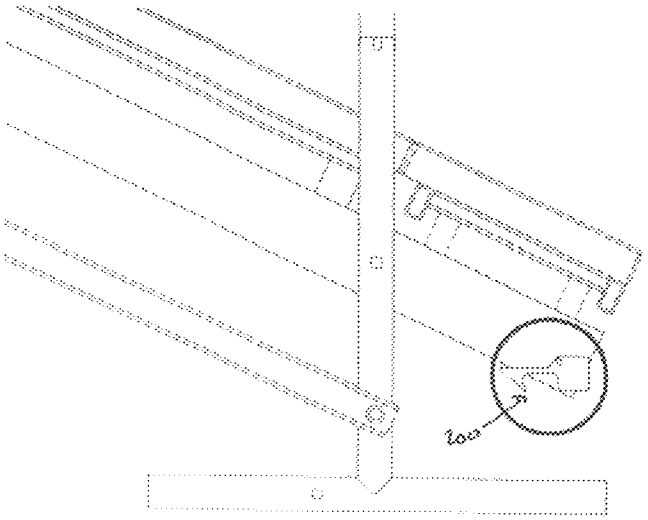

The present disclosure relates to one or more locking mechanisms joined to the frame of an exercise machine, as shown in FIGS. 3A-4B. One or more locking mechanisms may comprise one or more locking hook(s) 200, one or more locking arm(s) 300, and other such mechanisms known in the art. As a non-limiting example, locking hook(s) may include self-leveling, pivoting hook(s), as shown in FIGS. 3A-3B. A locking mechanism may also include rear spacer rods. The hook(s) are configured to automatically engage with such rear spacer rods as an exercise machine is lifted into a vertical folded position, as shown in FIG. 3B. This allows the machine to become securely locked in a variety of chosen orientations. In order to unlock an exercise machine that has been locked into a vertical position utilizing one or more locking mechanisms, a user may lift up on the front surface of a locking mechanism to disengage it from a spacer rod. Such lifting may be performed with a user's foot, though other methods may also be employed. By lifting with a user's foot, a locking mechanism including but not limited to a locking hook may be disengaged from a spacer rod. By engaging the unlocking device, a user may unlock a vertically positioned exercise machine and transition the machine into another orientation.

Figure 4B:
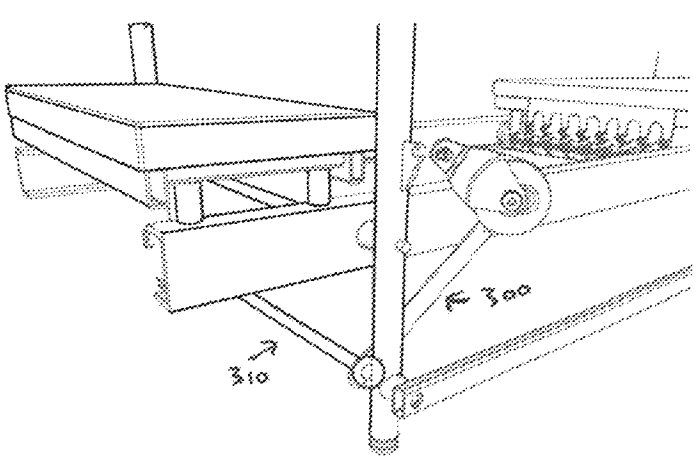
FIGS. 4A-4B show views of a locking arm according to the present disclosure.
Figure 4A:
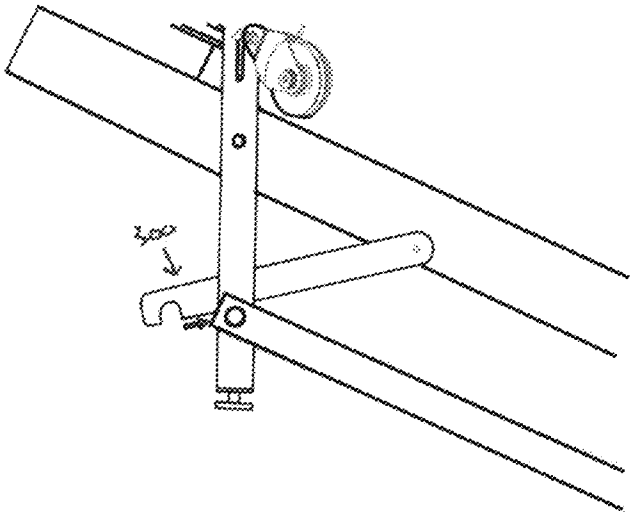

As a non-limiting example, one or more locking mechanisms may also include one or more locking arms 300, as discussed above. Such locking arm is a notched pivoting bar designed to automatically engage with a front spacer rod 310 of an exercise machine 10. The locking arm may engage the spacer rod when an exercise machine in a horizontal (i.e. "open") position, as shown in FIGS. 4A-4B. In such a capacity, an exercise machine may be locked in a horizontal orientation. In order to unlock an exercise machine that has been locked into a horizontal position utilizing a locking arm, a user may disengage the locking arm from a spacer rod, as shown in FIG. 4B. Disengaging the locking arm may include but is not limited to lifting the locking arm from a spacer rod. Lifting may be performed by a user with a user's hand. By lifting a locking arm, a user may unlock a horizontally positioned exercise machine and transition the machine into another orientation.

Figure 5B:
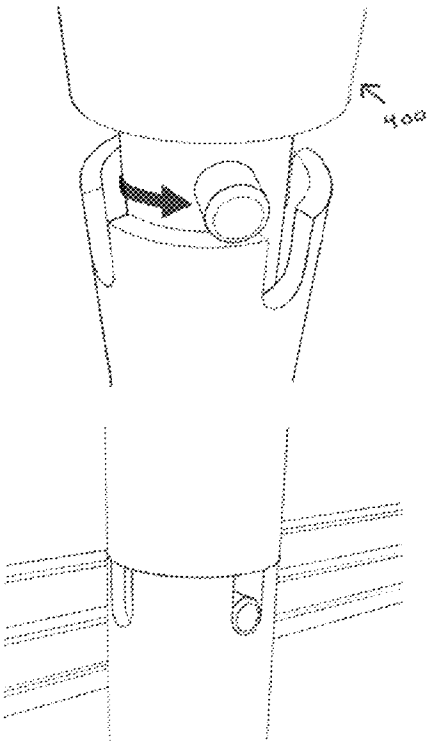
FIGS. 5A-5B show views of rotatable handlebars according to the present disclosure.
Figure 5A:
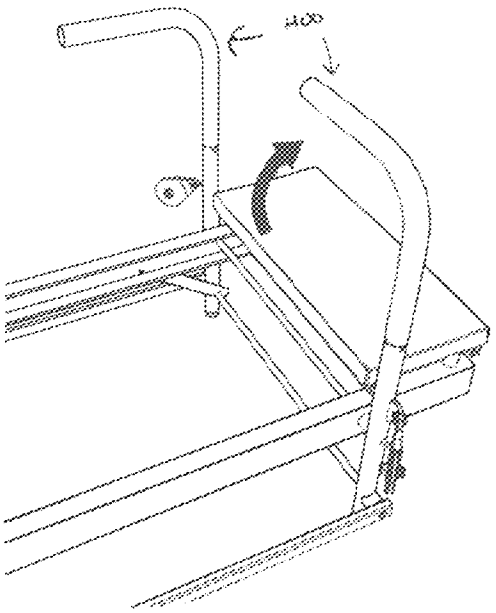
Figure 6B:
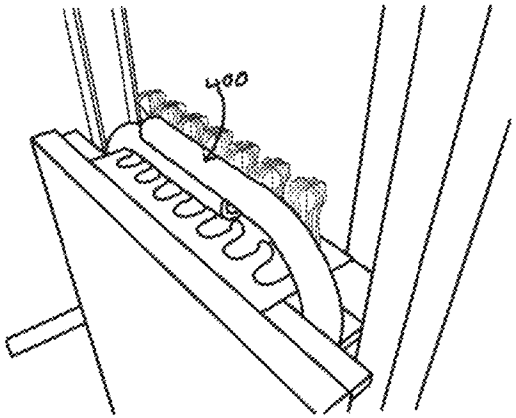
FIG. 6A-6B show functionalities of handlebars according to the present disclosure.
Figure 6C:
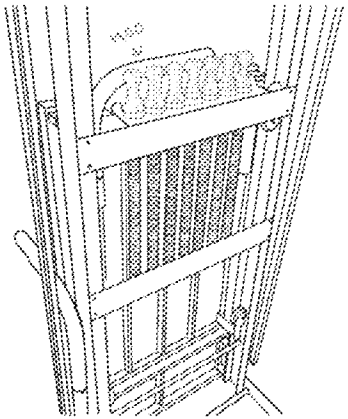

The present disclosure relates to one or more handles or handlebars 400. Handles or handlebars are adjustable and are configured to be selectively placed in different orientations to perform various functions, as shown in FIGS. 5A-5B. Handlebars are capable of rotating 360° and are configured to be locked in place at 90° increments. The rotation and locking functionalities are capable of being accomplished by utilizing a locking pin inserted into the handlebars. Such locking pin is configured to engage with various notches located in portions of an exercise machine, as shown in FIG. 5B. Handlebars are additionally configured to be removed from the portions of an exercise machine in which they are placed. Once removed, handlebars are configured to be stored in a space between a platform and tension springs of an exercise machine, as shown in FIGS. 6A-6B. This storage allows the overall height of a machine to be minimized while in a vertical (i.e. "folded") position. Such functionality allows a machine to fit in rooms with varying ceiling heights. Such functionality may allow a machine to fit in a room with a low ceiling height. Such functionality allows the length of a horizontally oriented machine, as described above, to be maintained during a transition from a horizontal orientation to a vertical orientation. The removability of handlebars may allow the length of a transitioning machine to be maintained in a room that is not tall enough to accompany the full height of a vertical machine in addition to the added height of handlebars, as shown in FIG. 2C.

Figure 7:
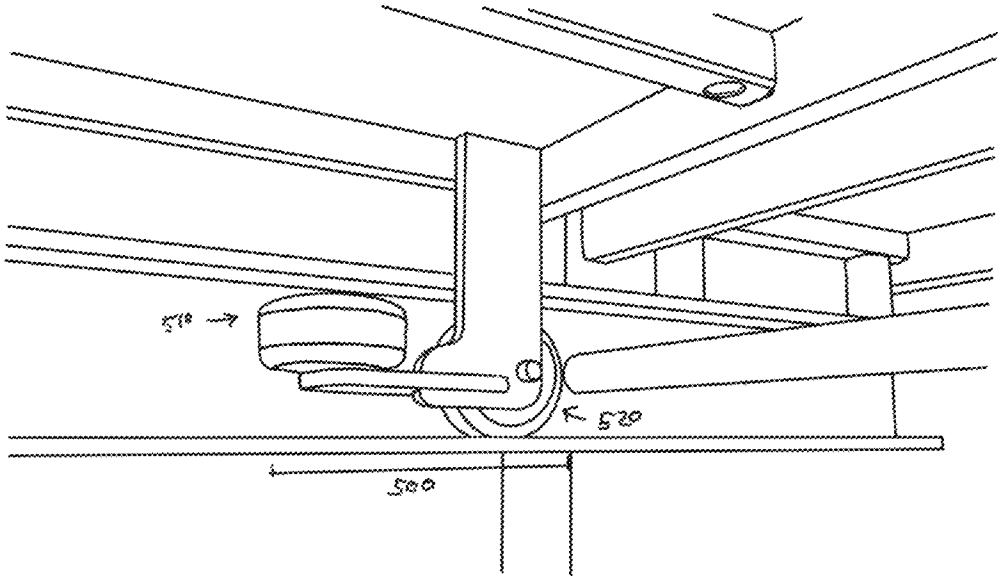

The present disclosure relates to a wheel assembly 500, as shown in FIG. 7. A wheel assembly may comprise one or more wheels, wherein a diameter of such a wheel 510 is oriented parallel to the length of an exercise machine, as shown in FIG. 7. A wheel assembly may additionally comprise one or more wheels 520, wherein a diameter of such a wheel is oriented perpendicular to the length of an exercise machine, as shown in FIG. 7. A perpendicular wheel smoothly rolls along the bottom edge of an aluminum C channel located in a frame rail of an exercise machine. A parallel wheel serves as a horizontally mounted guide. Such a guide keeps the travel of a platform straight during use. This functionality results from a parallel wheel rolling along the inside vertical walls of frame rails of an exercise machine. The combination of a perpendicular and parallel wheel in a wheel assembly allows for a moving platform to smoothly and linearly (i.e. in a straight direction) move along a frame of an exercise. Wheels of a wheel assembly may be selected from a variety of materials. Such materials may include polymers. Such polymers may include polyurethane.

Figure 8B:
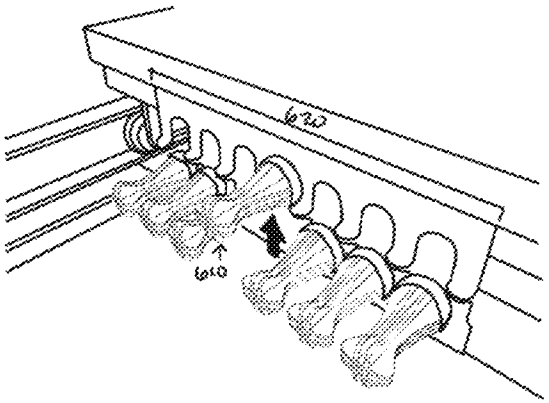
FIGS. 8A-8B show adjustable knobs and tension springs according to the present disclosure.
Figure 8A:
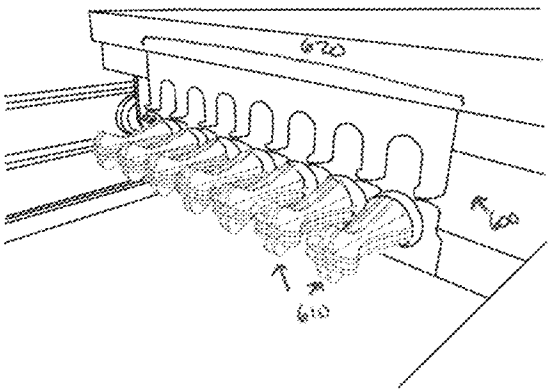

The present disclosure relates to a plurality of tension springs 600. Such tension springs are configured to individually engage with a series of securing devices 610. Securing devices may comprise any object known in the art to be capable of holding a spring in a notch. As a non-limiting example, a securing device can be a knob. Such securing devices may be affixed to both a static portion of the frame of an exercise machine and a leading edge of a moving platform of an exercise machine, as shown in FIGS. 8A-8B. The securing devices may be affixed to the leading edge of a moving platform by positioning securing devices into notches of a platform finger bracket 620. A platform finger bracket may be coupled to the end of the moving platform, as shown in FIG. 8B. In transitioning a securing device from a static portion of the frame to a leading edge of a platform, as shown in FIG. 8B, the tension of a tension spring may be transitioned to the moving platform. This assembly allows for a user of the exercise machine to variably adjust the tension resistance of a rolling platform. In order to variably adjust tension, the types (e.g. springs of varying spring coefficients) and quantities of springs engaged in notches of a finger bracket via securing devices may be adjusted to achieve desired resistance, as shown in FIG. 8B. In doing so, a variety of chosen combinations of types and quantities of springs provides an exercise machine adjustable tension levels.

Figure 9A:
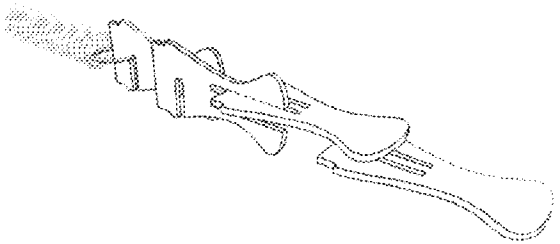
FIGS. 9A-9F show views of a securing device according to the present disclosure.
Figure 9B:
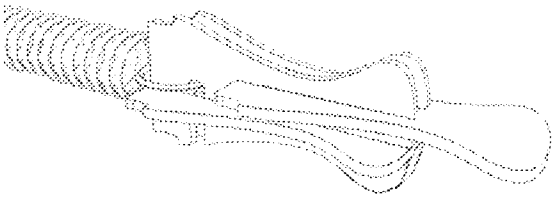
Figure 9C:
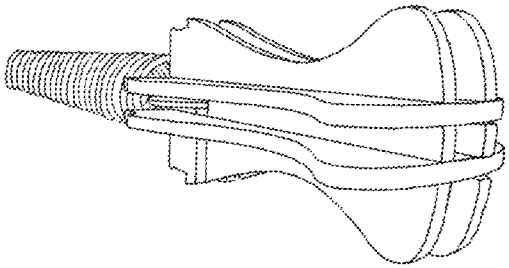
Figure 9D:
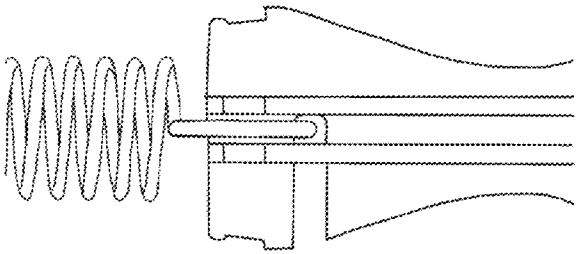
Figure 9E:
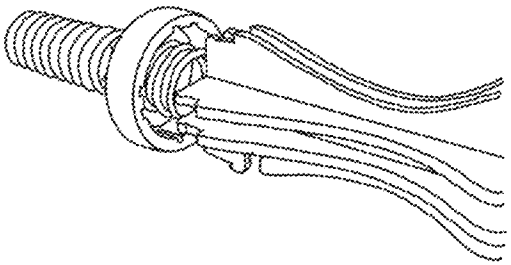
Figure 9F:
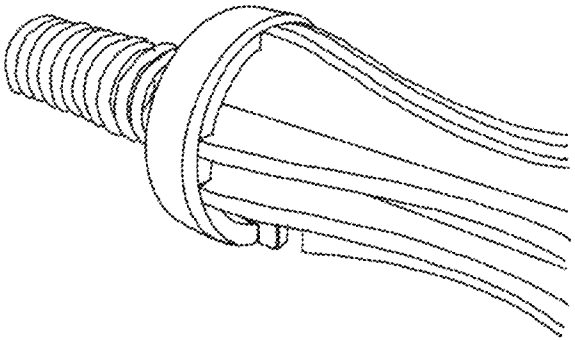

The present disclosure relates to an exemplary securing device. Such exemplary securing device is a knob. Such a knob may include a plurality of modular components, as shown in FIGS. 9A-9F. As a non-limiting example, a knob may include four or more modular components. Modular components of a securing device may be configured to engage each other to form an overall securing device. As a non-limiting example, a first set of modular components may be configured to engage a loop affixed to a spring. A first set may engage a loop of a spring through slots in the rear of the modular components. Grooves or slots in the rear of modular components may slidably engage a loop affixed to a spring, as shown in FIG. 9A. In engaging said loop, a first set of modular components may functionally be coupled to a spring and receive the tension of said spring. A second set of modular components of a securing device may be configured to slidably engage the first set through a number of grooves, as shown in FIGS. 9A-9B. A number of grooves may include but is not limited to two or more grooves located on the rear of each modular component of the second set. The first set of modular components may include a number of grooves located on the front of each modular component of the first set. The first set may include two or more grooves located on the front of each modular component of the first set. In slidably engaging a first set, a second set of modular components may become coupled to the first set of modular components, as shown in FIG. 9C. Once coupled to a first set of modular components, a second set of modular components may sandwich a loop affixed to a spring, as shown in FIG. 9D. Two sets of modular components coupled together to form a securing device, wherein the securing device is engaging a spring, may then receive an outer ring, as shown in FIGS. 9E-9F. An outer ring may provide structural support to a securing device by engaging pairs of notches located on the rears of individual modular components of the first and the second sets, as shown in FIG. 9E.

Figure 10A:
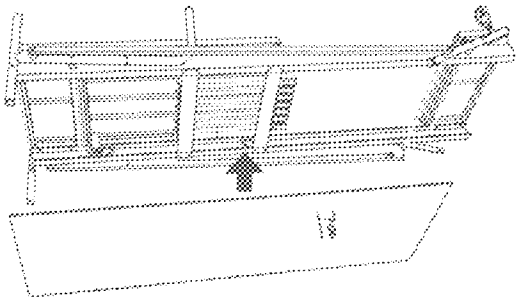
FIGS. 10A-10B show views of a mirror to be joined to an exercise machine according to the present disclosure.
Figure 10B:
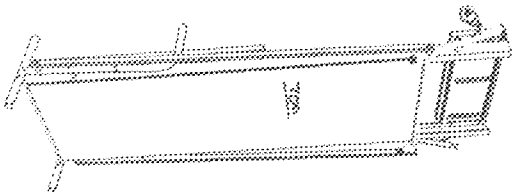
Figure 11A:
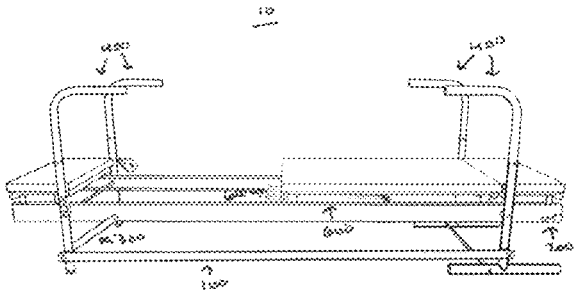
FIGS. 11A-11B show side views of an exercise machine in a horizontal (FIG. 11A) and a vertical (FIG. 11B) orientation.
Figure 11B:
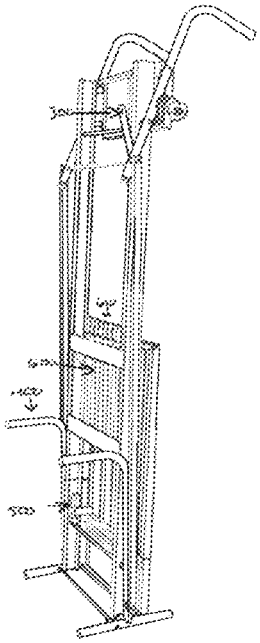

The present disclosure relates to an additional surface 700, as shown in FIGS. 10A-10B. An additional surface is configured be joined to bottom edges of main frame rails of an exercise machine. An additional surface is configured to be joined to an exercise machine for a variety of reasons. Such reasons may be functional, cosmetic, or a combination thereof. As a non-limiting example, a mirror may serve as an additional surface, as shown in FIGS. 10A-10B. A mirror may be joined to components of an exercise machine, resulting in a mounted mirror, as shown in FIGS. 10A-10B. An exercise machine is capable therein of providing additional functionalities while in a vertical (i.e. "folded") orientation. Such functionalities exist outside of the original use for exercise.

Having thus described exemplary embodiments of the present invention, it should be noted by those skilled in the art that the disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. An exercise machine comprising:

a frame configured to support a user;

a moving platform slidably disposed on a portion of the frame, wherein the moving platform is configured to move along a length of the frame;

one or more locking mechanisms coupled to the frame;

a plurality of adjustable handlebars coupled to the frame;

one or more wheel assemblies positioned within a channel of the frame, wherein the one or more wheel assemblies allows the moving platform to smoothly and linearly move along the frame; and a plurality of adjustable springs, wherein the plurality of springs are configured to engage one or more securing devices at one end and the frame at an opposing end, and wherein the one or more securing devices is configured to be received within one or more notches of a platform finger bracket coupled to an end of the moving platform; and wherein the one or more securing devices comprise: one or more knobs, the one or more knobs comprising:

a first set of modular components configured to engage a loop affixed to a spring of the plurality of springs, wherein the first set comprises a number of grooves located on a front of each modular component;

a second set of modular components configured to slidably engage the first set through a number of grooves located on a rear of each modular component;

and an outer ring configured to engage notches located on the rears of respective modular components of the first and the second sets to provide structural support to the securing device.

2. The exercise machine of claim 1, wherein the exercise machine is configured to be folded into a vertical orientation to facilitate storage.

3. The exercise machine of claim 2, wherein the length of the frame is the same in both a horizontal and the vertical orientations.

4. The exercise machine of claim 3, wherein a variety of exercises can still be performed on the exercise machine using the moving platform in combination with cable and pulley systems while the exercise machine is in the vertical orientation.

5. The exercise machine of claim 1, wherein the one or more locking mechanisms engage one or more spacer rods to lock the exercise machine in a chosen orientation.

6. The exercise machine of claim 1, wherein the plurality of handlebars are capable of be rotated 360 degrees about an axis.

7. The exercise machine of claim 1, wherein one or more of the plurality of handlebars is configured to be locked at increments of 90 degrees by engaging a locking pin with various notches.

8. The exercise machine of claim 1, wherein the plurality of handlebars is configured to be removed to facilitate ease of storage.

9. The exercise machine of claim 1, wherein one or more wheel assemblies comprise:

a first wheel, wherein a diameter of said first wheel is oriented parallel to the length of the exercise machine; and, a second wheel, wherein a diameter of said second wheel is oriented perpendicular to the length of the exercise machine.

10. The exercise machine of claim 1, wherein one or more wheel assemblies comprise polyurethane wheels.

11. The exercise machine of claim 1, wherein the plurality of adjustable springs comprises a variety of springs of varied spring coefficients, and wherein a chosen combination of said variety of springs is capable of being selectively positioned within the one or more notches of the platform finger bracket to provide the exercise machine adjustable tension levels.

* * * * *